US005588401A

United States Patent [19]

Matsumoto et al.

[11] Patent Number: 5,588,401

[45] Date of Patent: Dec. 31, 1996

[54] SPARK IGNITION INTERNAL-COMBUSTION ENGINE

[75] Inventors: Yakihiro Matsumoto; Hisashi Yokotaki, both of Wako, Japan

[73] Assignee: Honda Giken Kogyo Kabushiki Kaisha, Tokyo, Japan

[21] Appl. No.: 405,248

[22] Filed: Mar. 17, 1995

[30] Foreign Application Priority Data

Mar. 18, 1994 [JP] Japan ..... 6-072833

[51] Int. Cl.[6] ..... F02D 7/00

[52] U.S. Cl. ..... 123/41.31; 123/146.50 A; 123/635

[58] Field of Search ..... 123/41.31, 146.5 A, 123/634, 635, 647

[56] References Cited

U.S. PATENT DOCUMENTS 1,532,787 4/1925 Taylor ..... 123/635
1,683,239 9/1928 Chryst ..... 123/647 X
1,832,848 11/1931 Nacker ..... 123/635 X
4,134,370 1/1979 Iwahashi et al. ..... 123/41.31

FOREIGN PATENT DOCUMENTS 5-41239 10/1993 Japan .

*Primary Examiner*—Tony M. Argenbright
*Attorney, Agent, or Firm*—Armstrong, Westerman, Hattori, McLeland & Naughton

[57] ABSTRACT

A spark ignition internal-combustion engine, wherein an ignition coil is mounted on the engine, in the vicinity of a distributor fixedly mounted on the engine, and the ignition coil is disposed behind the opening section of a radiator fan. The engine is mounted in the front part of an automotive body, with a crankshaft directed in the direction of breadth of the automobile. The ignition coil is mounted on the front bank of the engine. Beside the ignition coil is disposed a battery and a reservoir tank; between the battery and reservoir tank and the front bank is formed an ignition coil cooling air duct. A mounting member for mounting the ignition coil to the engine is partially extended between the ignition coil and the distributor to cover the coil section of the ignition coil.

30 Claims, 4 Drawing Sheets

SPARK IGNITION INTERNAL-COMBUSTION ENGINE

BACKGROUND OF THE INVENTION

1. Field of the Invention

The present invention relates to a spark ignition internal-combustion engine and, more particularly, to the arrangement of an ignition coil in a high-tension spark ignition internal-combustion engine for automobiles.

2. Description of the Related Art

In the spark ignition internal-combustion engine, a distributor connected to spark plugs is generally mounted in a vicinity of an upper part of an engine cylinder head. To facilitate wiring installation it is advantageous that the ignition coil connected to this distributor by a wiring harness is disposed as close to the distributor as possible.

There has been disclosed an engine for industrial use in Japanese Utility Model Publication No. Hei 5-41239 in which the distributor is disposed in the upper part of the engine, and the ignition coil is mounted on an engine mount bracket located below the distributor, thereby decreasing a distance between the distributor and the ignition coil as much as possible.

There, however, exists some distance between the upper part of the engine where the distributor is mounted and the engine mount bracket on which the ignition coil is installed; therefore the ignition coil is not located very close to the distributor though present below and in the vicinity of the distributor.

In the meanwhile, if the ignition coil is located very close to the distributor, the distributor will be adversely affected by the heat of the ignition coil. Furthermore, a distributor with a built-in electromagnetic pick-up section has such a problem that the magnetic field of the ignition coil will have an effect on the electromagnetic pick-up section of the distributor.

SUMMARY OF THE INVENTION

In view of the above-described problem, it is an object of the present invention to provide a spark ignition internal-combustion engine wherein a distributor and an ignition coil are contiguously disposed to provide a short harness therebetween and to prevent giving an effect of the heat or magnetic field of the ignition coil to the distributor.

In order to accomplish the above-described object, the ignition coil in the present invention is mounted to the engine, in the vicinity of the distributor fixedly mounted on the engine, and is disposed behind a fan opening section of radiator.

Since the ignition coil is mounted in the vicinity of the distributor, it is possible to decrease the length of the wiring harness between the ignition coil and the distributor, thereby facilitating the installation of the harness. In addition, since the ignition coil is disposed behind the fan opening section of the radiator, the ignition coil can be cooled effectively to prevent transferring an undue amount of heat to the distributor.

The mounting member for mounting the ignition coil to the engine is partly extended between the ignition coil and the distributor, thereby blocking the magnetic field of the ignition coil to prevent giving an effect to the distributor.

DETAILED DESCRIPTION OF THE PREFERRED EMBODIMENTS

Hereinafter preferred embodiments of a spark ignition internal-combustion engine according to the present invention will be explained with reference to the accompanying drawings FIGS. 1 to 4.

Figure 1:
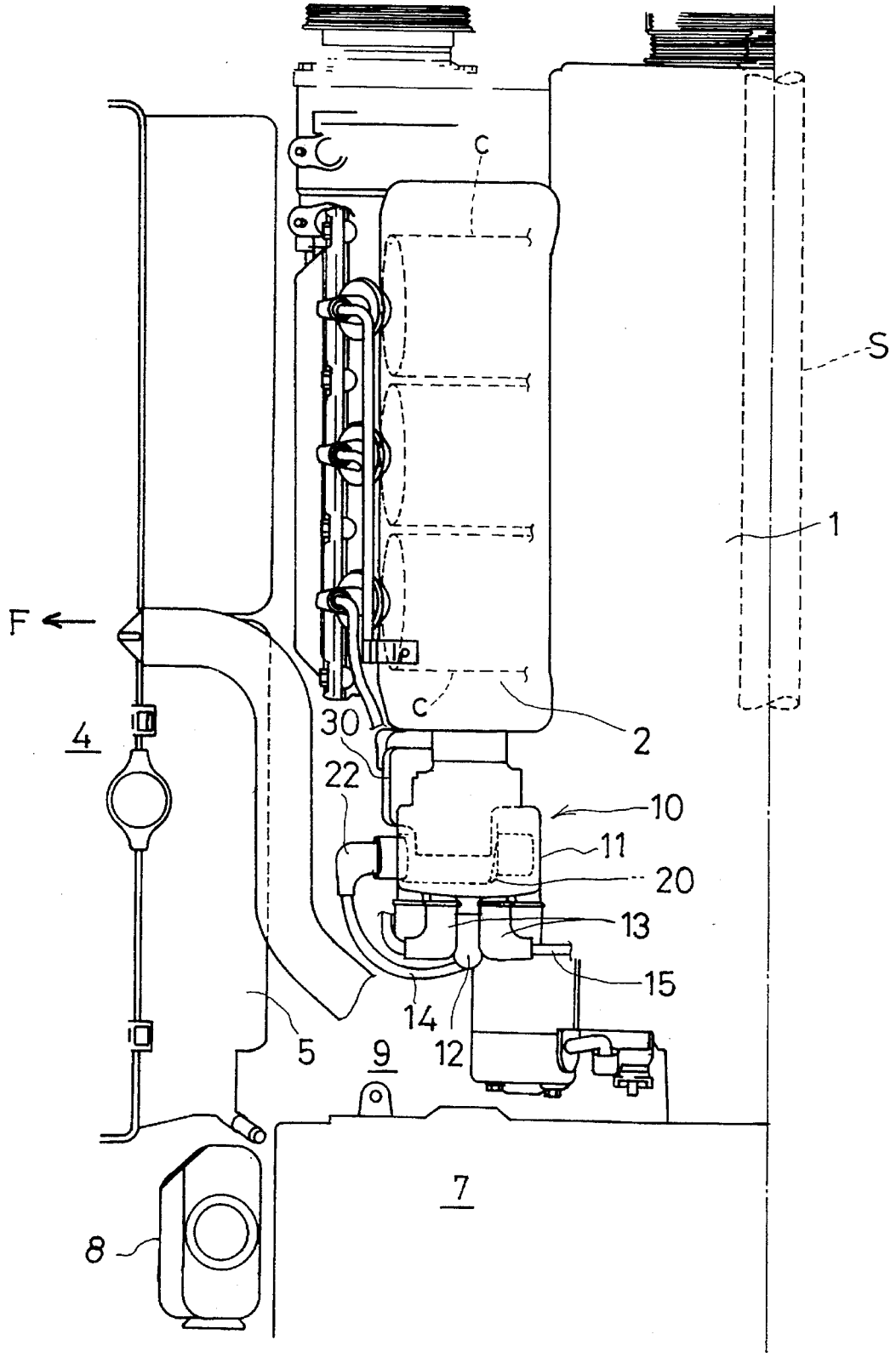
FIG. 1 is a partial plan view showing one embodiment of a V-6 engine and its vicinity according to the present invention.

The present embodiment, for example, utilizes a V-6 (V type, six cylinders) engine 1 mounted on an automobile in which a distributor 10 and an ignition coil 20 are provided. The V-6 engine 1 is mounted in the front part of the automotive body with a transverse mounted crankshaft S. As shown in FIG. 1, a radiator 4 is disposed in front of the engine 1. The engine 1 has front and rear banks 2 and 3 set at an angle to each other, forming a V-shape. In either of the banks 2 and 3 are arranged three cylinders C. On the left side of the front bank 2 is mounted a battery 7 with a clearance provided at the left end of the bank 2. A reservoir tank 8 is mounted along the front face of the battery 7.

A wall constituting an air duct 9 for leading the air backwards is formed on the upper left side of the engine 1, between the battery 7 and the reservoir tank 8 and the left end of the bank 2.

The distributor 10 protrudes toward the air duct 9 on the left end face of the cylinder head part of the bank 2.

A cap 11 incorporating a high-tension electrode of the distributor 10 faces leftwards; from a high-tension terminal 12, a high-tension cord 14 connected to the ignition coil 20 extends. From high-tension terminals 13 disposed at six places around the high-tension terminal 12, high-tension cords 15 connected to six spark plugs of the cylinders in the banks 2 and 3 extend.

Below the distributor 10, the ignition coil 20 is located close to it.

A bracket 30 for attaching the ignition coil 20 to the engine 1 is an L-shaped plate member which comprises a vertical plate portion 31 secured in contact with the left side wall of the cylinder head of the bank 2, and a horizontal plate portion 32 bent leftwards at the upper edge of the vertical plate portion 31 and extending horizontally to suspend the ignition coil 20.

Figure 4:
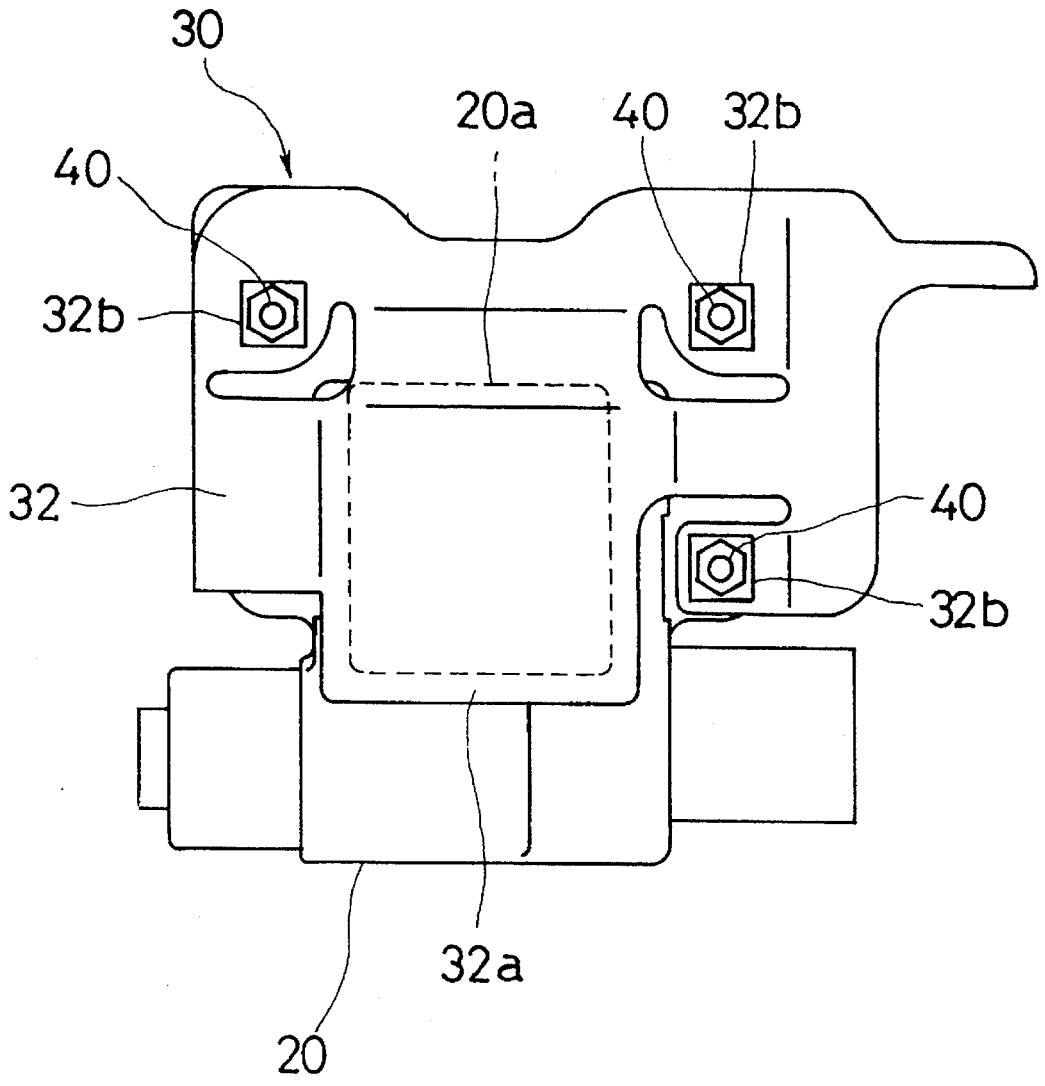
FIG. 4 is a plan view showing the state of an ignition coil fixedly mounted on a mounting bracket.

The ignition coil 20 is disposed and secured at a corner formed by the vertical plate portion 31 and the horizontal plate portion 32. FIG. 4 is a plan view showing the state of the ignition coil 20 thus secured on the bracket 30. Bolts 40 inserted through from above into mounting positions **32*b* located at three places of the horizontal plate portion 32 are threadedly installed in the upper wall of the ignition coil 20 case, thus fixedly installing the ignition coil 20 to the horizontal plate portion 32**.

The horizontal plate portion 32 has an extension portion **32*a* extending to the left, covering from above the ignition coil 20 excepting a part of the left-hand side of the ignition coil 20. A coil section 20*a* of the ignition coil 20 indicated by a broken line in the drawing is covered fully with the horizontal plate portion 32 and the extension portion 32***a*.

The bracket 30 with the ignition coil 20 suspended from the lower surface of the horizontal plate portion 32 as stated above, is fixed to the cylinder head of the bank 2 by abutting the vertical plate portion 31, beneath the distributor 10, and then securing to the cylinder head with the bolts 41 inserted in mounting holes located at three places of the vertical plate portion 31.

The ignition coil 20 is disposed in the vicinity of the distributor 10 mounted above it. The horizontal plate portion 32 of the mounting bracket 30 is interposed in a small gap located between the ignition coil 20 and the distributor 10. The horizontal plate portion 32, together with its extension portion 32*a*, covers the coil section 20*a* of the ignition coil 20, to form a wall of magnetic shield, thereby completely shielding the magnetic field occurring in the ignition coil 20 to prevent giving an effect to the distributor 10.

To the high-tension terminal 22 protruding forwards of the ignition coil 10, the high-tension cord 14 extending from the high-tension terminal 12 at center of the cap 11 of the distributor 10 is connected.

Figure 2:
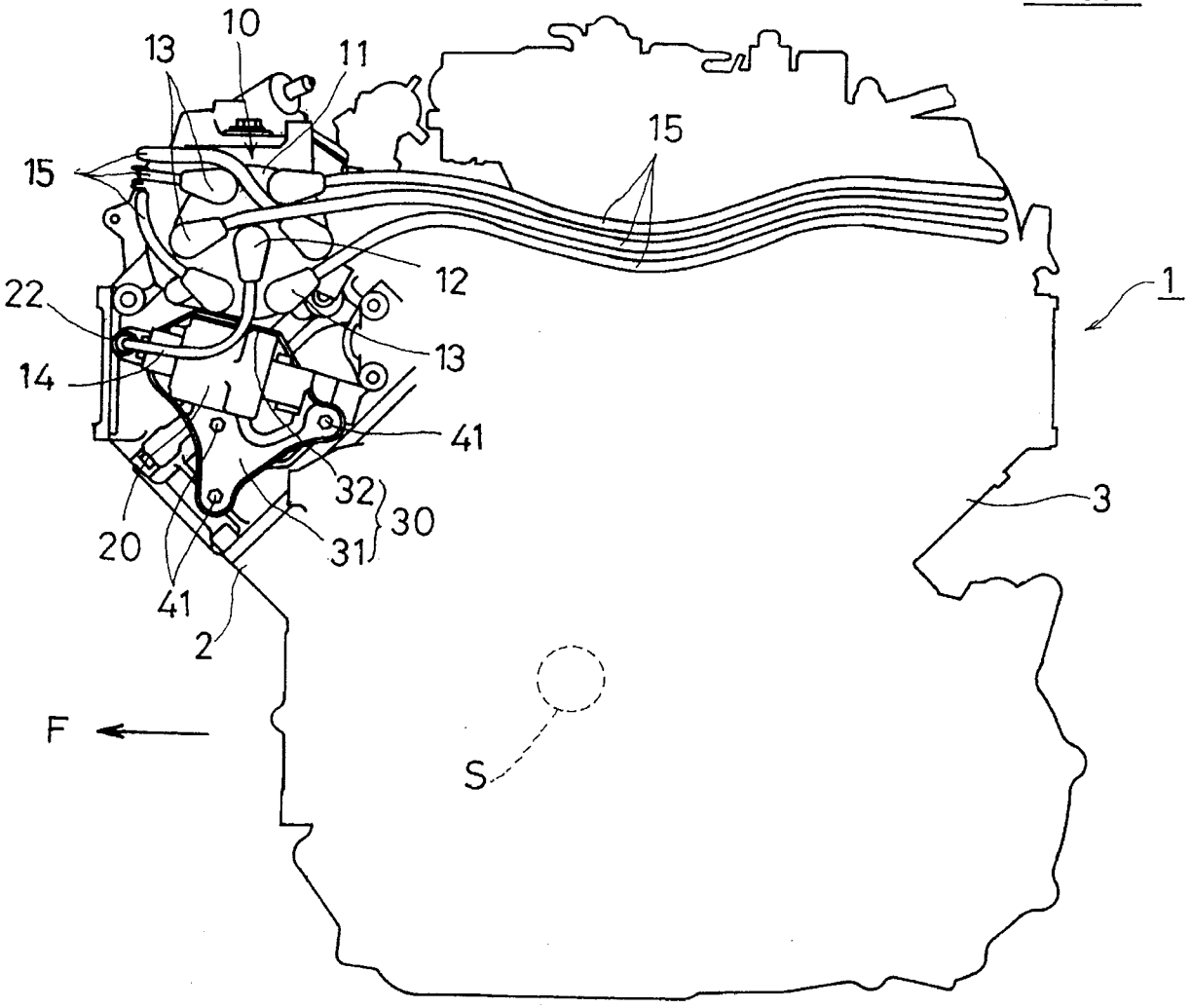
FIG. 2 is a partial side view of the same engine.

The ignition coil 20 is mounted close to the distributor 10, with a slight clearance provided to allow interposition of the horizontal plate portion 32 Of the mounting bracket 30, and the high-tension terminal 22 of the ignition coil 20 is disposed a little ahead of, and below, the main body of the distributor 10 as shown in FIG. 2. Therefore there is needed only a short high-tension cord 14 for connection between the ignition coil 20 and the distributor 10, and the high-tension cord 14 can be easily installed.

Figure 3:
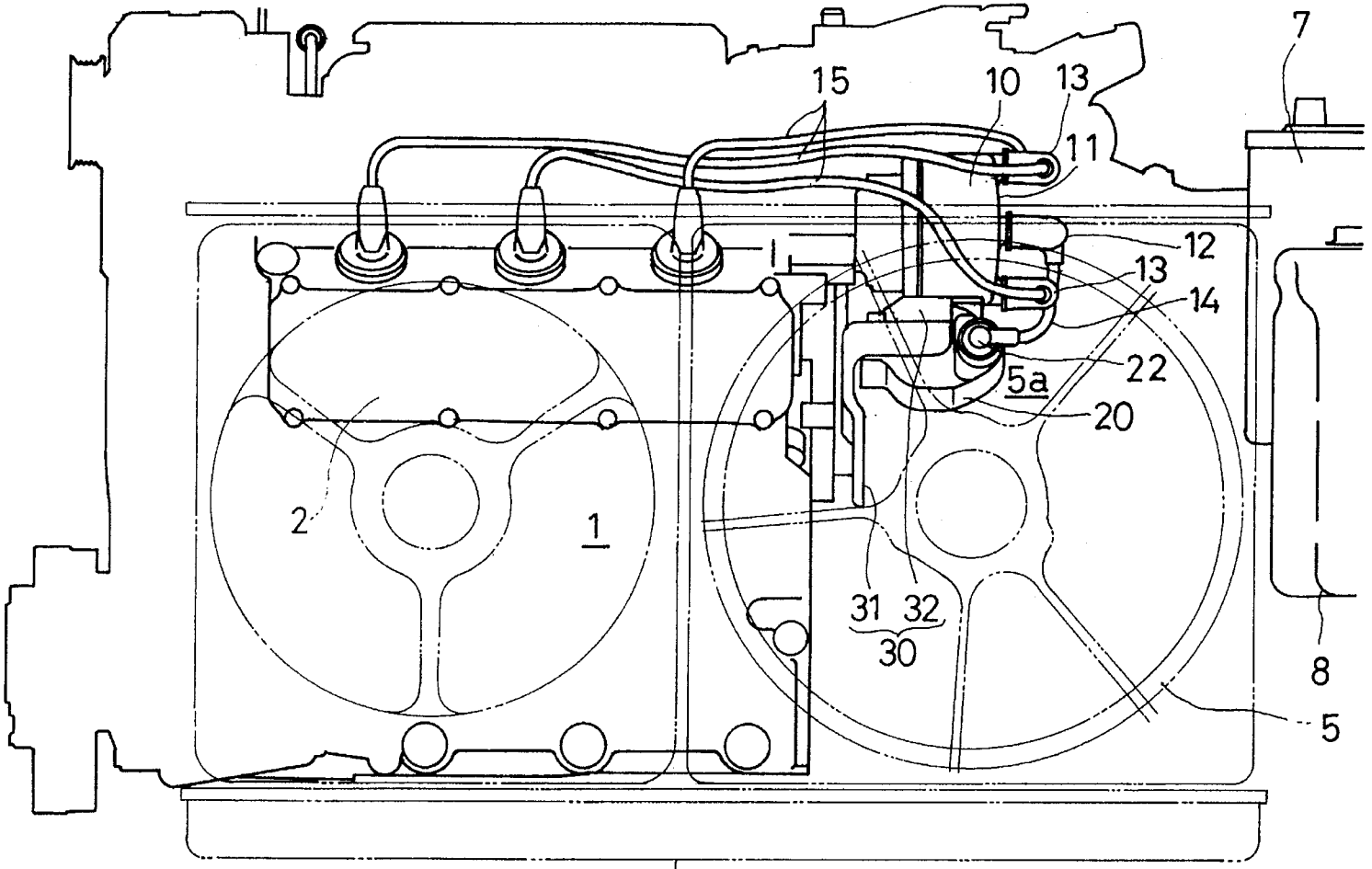
FIG. 3 is a partial front view of the same engine and its vicinity.

In front of the ignition coil 20 is mounted the radiator fan 5 of the radiator 4, and also there is positioned the opening section 5*a* of the radiator fan 5. FIG. 3 is a front view showing the engine 1 and its vicinity, in which the radiator 4 is schematically indicated by an imaginary line The ignition coil 20 is disposed just behind the opening section 5*a* of the radiator fan 5.

Therefore, since the ignition coil 20 is effectively cooled by the cooling air from the opening section 5*a* of the radiator fan, it is possible to protect the distributor 10 from the adverse effects of heat without providing a special cooling means if the ignition coil 20 is located close to the distributor 10.

Because the reservoir tank 8 and the battery 7 are juxtaposed in before and behind on the left of the cylinder head of the engine 1 to thereby form the air duct 9, the cooling air coming from the opening section 5*a* of the radiator fan is led to the air duct 9 without being diverted sidewards, thus effectively cooling the ignition coil 20 which protrudes into this air duct 9 and accordingly always maintaining a high cooling effect notwithstanding operating condition.

The mounting bracket 30 for securing the ignition coil 20 to the engine 1 is of such a design that its vertical plate portion 31 is disposed along the left side wall of the cylinder head and that the ignition coil 20 is suspended from the horizontal plate portion 32 bent leftwards from the vertical plate portion 31. Thus, the cooling air is not blocked by the mounting bracket 30 and the ignition coil 20 is directly exposed to the cooling air for gaining a high cooling effect.

Although the distributor 10 has a built-in electromagnetic pick-up section as described above, the electromagnetic pick-up section is protected from an effect of the magnetic field produced by the ignition coil 20, and prevented from making a malfunction, if the ignition coil 20 is mounted close to the distributor 10, because the horizontal plate portion 32 of the mounting bracket 30 and its extension portion 32*a* are interposed between the distributor 10 and the ignition coil 20 to form the wall of magnetic shield.

It is also possible to improve the control accuracy of various control systems which are liable to be affected by a magnetic noise.

The mounting bracket 30 is preferably a steel bracket, whose horizontal plate portion 32 and extension section 32*a* absorb the magnetic field for a magnetic shielding purpose. However, the horizontal plate portion 32 and its extension portion 32*a* may be produced of a non-magnetic rubber to shut off the magnetism.

What is claimed is:

1. A spark ignition internal-combustion engine comprising an ignition coil mounted on an engine body in the vicinity of a distributor fixedly mounted directly on said engine body, said ignition coil being disposed directly behind an opening section of a radiator fan.

2. A spark ignition internal-combustion engine according to claim 1, further comprising a mounting member for mounting said ignition coil to said engine body, wherein said mounting member includes an extended portion interposed between said ignition coil and said distributor.

3. A spark ignition internal-combustion engine according to claim 2, wherein said extended portion of said mounting member interposed between said ignition coil and said distributor covers a coil section of said ignition coil.

4. A spark ignition internal-combustion engine according to claim 2, wherein said ignition coil is secured to an end face of a cylinder head at one end in a direction of a crankshaft.

5. A spark ignition internal-combustion engine according to claim 1, further comprising a battery mounted beside said ignition coil, wherein said battery forms an air duct for cooling said ignition coil.

6. A spark ignition internal-combustion engine according to claim 5, further comprising a reservoir tank disposed ahead of said battery.

7. A spark ignition internal-combustion engine according to claim 1, comprising an ignition coil mounting member having a vertical plate portion fixed on said cylinder head and a horizontal plate portion bent from said vertical plate portion, said ignition coil being suspended from said horizontal plate portion.

8. A spark ignition internal-combustion engine according to claim 1, wherein said engine is an automotive engine mounted in the front part of an automotive body, said automotive engine comprising:

a crankshaft mounted in a transverse direction of said automotive body; and front and rear cylinder banks set at an angle to each other protruding in a V-shape, wherein said ignition coil is mounted on said front cylinder bank.

9. A spark ignition internal-combustion engine according to claim 8, further comprising a battery disposed beside said ignition coil, thereby forming an air conduit for cooling said ignition coil.

10. A spark ignition internal-combustion engine according to claim 9, further comprising a reservoir tank disposed in front of said battery.

11. A spark ignition internal-combustion engine according to claim 8, further comprising an ignition coil mounting member including a vertical plate portion fixed on a cylinder head and a horizontal plate portion bent from said vertical plate portion, said ignition coil being suspended from said horizontal plate portion.

12. A spark ignition internal-combustion engine according to claim 8, further comprising a mounting member for mounting said ignition coil to said engine body, wherein said mounting member includes an extended portion interposed between said ignition coil and said distributor.

13. A spark ignition internal-combustion engine according to claim 12, wherein said ignition coil is secured to one end surface of a cylinder head in a direction of a crankshaft.

14. A spark ignition internal-combustion engine according to claim 13, wherein said extended portion of said mounting member interposed between said ignition coil and said distributor covers a coil section of said ignition coil.

15. A spark ignition internal-combustion engine comprising:

an ignition coil mounted on an engine body by a mounting member in a vicinity of a distributor fixedly mounted directly on said engine body, wherein said mounting member includes an extended portion interposed between said ignition coil and said distributor.

16. A spark ignition internal-combustion engine according to claim 15, wherein said ignition coil is secured to one end surface of a cylinder head in a direction of a crankshaft.

17. A spark ignition internal-combustion engine according to claim 15, wherein said distributor has a built-in electromagnetic pick-up section.

18. A spark ignition internal-combustion engine according to claim 17, wherein said extended portion of said mounting member interposed between said ignition coil and said distributor covers a coil section of said ignition coil.

19. A spark ignition internal-combustion engine according to claim 15, wherein said engine is an automotive engine mounted in the front part of an automotive body, said automotive engine comprising:

a crankshaft mounted in a transverse direction of said automotive body; and front and rear cylinder banks set at an angle to each other, protruding in a V-shape, wherein said ignition coil is mounted on said front cylinder bank.

20. A spark ignition internal-combustion engine, comprising an ignition coil mounted on an engine body, said ignition coil being disposed directly behind and within a periphery of an opening section of a radiator fan.

21. A spark ignition internal-combustion engine comprising an ignition coil mounted on an engine body, said ignition coil being disposed directly behind an opening section of a radiator fan, wherein said ignition coil is secured to one end face of a cylinder head in a direction of a crankshaft.

22. A spark ignition internal-combustion engine comprising an ignition coil mounted on an engine body, said ignition coil being disposed directly behind an opening section of a radiator fan, further comprising a battery mounted beside said ignition coil, wherein said battery forms an air duct for cooling said ignition coil.

23. A spark ignition internal-combustion engine comprising an ignition coil mounted on an engine body, said ignition coil being disposed directly behind an opening section of a radiator fan, further comprising an ignition coil mounting member having a vertical plate portion fixed on a cylinder head and a horizontal plate portion bent from said vertical plate portion, said ignition coil being suspended from said horizontal plate portion.

24. A spark ignition internal-combustion engine comprising an ignition coil mounted on an engine body, said ignition coil being disposed directly behind an opening section of a radiator fan, wherein said engine is an automotive engine mounted in a front part of an automotive body, said automotive engine comprising:

a crankshaft mounted in a transverse direction of said automotive body; and front and rear cylinder banks set at an angle to each other protruding in a V-shape, wherein said ignition coil is mounted on said front cylinder bank.

25. A spark ignition internal-combustion engine comprising an ignition coil mounted on an engine body in a vicinity of a distributor fixedly mounted on said engine body, said ignition coil being disposed behind an opening section of a radiator fan and secured to the end face of a cylinder head in a direction of a crankshaft.

26. A spark ignition internal-combustion engine comprising:

an ignition coil mounted on an engine body in a vicinity of a distributor fixedly mounted on said engine body; and an ignition coil mounting member having a vertical plate portion fixed on a cylinder head and a horizontal plate portion bent from said vertical plate portion;

said ignition coil being disposed behind an opening section of a radiator fan and suspended from said horizontal plate portion.

27. A spark ignition internal-combustion engine which is an automotive engine mounted in a front part of an automotive body comprising:

a crankshaft mounted in a transverse direction of said automotive body;

front and rear cylinder banks set at an angle to each other protruding in a V-shape;

a distributor fixedly mounted on an engine body; and an ignition coil mounted on an engine body; and an ignition coil mounted on said front cylinder bank in a vicinity of said distributor and disposed behind an opening section of a radiator fan.

28. A spark ignition internal-combustion engine comprising:

an ignition coil secured to one end surface of a cylinder head in a direction of a crankshaft by a mounting member in a vicinity of a distributor fixedly mounted on an engine body, wherein said mounting member includes an extended portion interposed between said ignition coil and said distributor.

29. A spark ignition internal-combustion engine comprising:

an ignition coil mounted on an engine body by a mounting member in a vicinity of a distributor fixedly mounted on said engine body, wherein said distributor has a built-in electromagnetic pick-up section, and said mounting member includes an extended portion interposed between said ignition coil and said distributor.

30. A spark ignition internal-combustion engine which is an automotive engine mounted in a front part of an automotive body comprising:

a crankshaft directed in a transverse direction of said automotive body;

front and rear cylinder banks set at an angle to each other protruding in a V-shape, and an ignition coil mounted on said front cylinder bank by a mounting member in a vicinity of a distributor fixedly mounted on an engine body, wherein said mounting member includes an extended portion interposed between said ignition coil and said distributor.

* * * * *